US010598454B2

(12) United States Patent
DiChario et al.

(10) Patent No.: US 10,598,454 B2
(45) Date of Patent: Mar. 24, 2020

(54) MAGAZINE ADAPTER

(71) Applicant: American Tactical, Inc., Summerville, SC (US)

(72) Inventors: Anthony DiChario, Eutawville, SC (US); Roger Ellison Cribb, St. George, SC (US); Richard Peck, Summerville, SC (US)

(73) Assignee: American Tactical, Inc., Summerville, SC (US)

( * ) Notice: Subject to any disclaimer, the term of this patent is extended or adjusted under 35 U.S.C. 154(b) by 0 days.

(21) Appl. No.: 16/251,547

(22) Filed: Jan. 18, 2019

(65) Prior Publication Data

US 2019/0226779 A1 Jul. 25, 2019

Related U.S. Application Data

(60) Provisional application No. 62/620,440, filed on Jan. 22, 2018.

(51) Int. Cl.

| | |
|---|---|
| ***F41A 9/61*** | (2006.01) |
| ***F41A 9/71*** | (2006.01) |
| ***F41A 9/82*** | (2006.01) |
| ***F41A 9/59*** | (2006.01) |

(52) U.S. Cl.

CPC ..... *F41A 9/71* (2013.01); *F41A 9/59* (2013.01); *F41A 9/82* (2013.01)

(58) Field of Classification Search

CPC ..... F41A 9/71

See application file for complete search history.

(56) References Cited

U.S. PATENT DOCUMENTS 4,056,038 A * 11/1977 Rath ..... F41A 5/18 89/128
4,297,800 A * 11/1981 Atchisson ..... F41A 11/02 42/49.02
6,070,352 A * 6/2000 Daigle ..... F41A 11/02 42/49.02

(Continued)

FOREIGN PATENT DOCUMENTS

WO WO-2013017907 A1 * 2/2013 ..... F41A 9/71

*Primary Examiner* — Gabriel J. Klein

(74) *Attorney, Agent, or Firm* — Woods Oviatt Gilman LLP; Katherine H. McGuire, Esq.

(57) ABSTRACT

A magazine adapter for use in a firearm includes a magazine adapter body configured to be bottom-fed and detachably received within a magazine well on the firearm. The magazine adapter body has a bottom panel, an upwardly extending first panel and an upwardly extending second panel defining a channel therebetween proportioned to slidably receive a magazine therein. The second panel defines a groove configured to engage a firearm magazine catch on the firearm when the magazine adapter body is received within the magazine well. The magazine adapter body may detach from the magazine well when the firearm magazine catch is actuated. The first panel includes an adapter magazine catch configured to releasably engage the magazine when the magazine is received within the magazine adapter channel. A magazine release is coupled to the adapter magazine catch. The adapter magazine catch disengages from the magazine when the magazine release is actuated.

7 Claims, 5 Drawing Sheets

(56) References Cited

U.S. PATENT DOCUMENTS

| | | | | |
|---|---|---|---|---|
| 7,444,775 | B1 * | 11/2008 | Schuetz | F41A 9/71<br>42/49.02 |
| 10,260,827 | B2 * | 4/2019 | Mock | F41A 3/66 |
| 2017/0138685 | A1 * | 5/2017 | Beasley | F41A 9/71 |

* cited by examiner

MAGAZINE ADAPTER

CROSS-REFERENCE TO RELATED APPLICATIONS

This application claims the benefit of U.S. Provisional Patent Application No. 62/620,440, filed Jan. 22, 2018, entitled MAGAZINE ADAPTER, the entirety of which is incorporated herein by reference.

FIELD OF THE INVENTION

The present invention relates to a magazine adapter, and more particularly, to a magazine adapter configured to receive a 9 mm magazine for use within an automatic or semi-automatic assault-type firearm. Specifically, the present invention relates to a magazine adapter configured to receive a 9 mm magazine for use within an M-16/AR-15 firearm.

BACKGROUND OF THE INVENTION

There are a number of available automatic and semi-automatic firearms for use by military personnel and civilians. While fully automatic firearms are generally illegal for use by the civilian population, many of the components which constitute an automatic firearm are the same as those found within legal semi-automatic models. Arguably the most popular semi-automatic assault-type firearm used by civilians, particularly within the United States, is the AR-15. The AR-15 is the semi-automatic variant of the fully automatic M16 firearm used by United States military personnel. While AR-15 is a registered trademark of Colt Industries, a number of additional manufacturers manufacture clones of the AR-15 and market these clones under separate trademarks. While used throughout the specification, it is to be understood that the term AR-15 is meant to include not only those firearms manufactured by Colt Industries, but also those additional clones and any variants thereof.

The AR-15 and M16 are designed as modular firearms generally comprising a buttstock, lower receiver, upper receiver and barrel assembly configured to file .223 Remington or 5.56×45 mm NATO military ammunition. Each component is separable from one another and affords firearm owners the opportunity to customize the firearm with aftermarket components such as barrels of differing lengths, upper receivers designed to handle different calibers of rifle ammunition, flashlights, hand guards, grenade or flare launchers, flash or sound suppressors, grips, and front or rear sights. To operate, the lower receiver is configured to include a trigger wherein activation of the trigger causes a rifle cartridge housed within the chamber of the upper receiver to be fired out the barrel of the firearm by action of a reciprocating bolt carrier group. Internal mechanisms of the upper receiver expel the shell casing of the fired rifle cartridge from the chamber while components engaged with the magazine housed within the magazine well of the lower receiver feed a new rifle cartridge into the now-empty chamber. The buttstock mounts to the lower receiver and includes a buffer assembly and action (or recoil) spring in communication with the bolt carrier group where the spring pushes the bolt carrier group back toward the chamber in preparation of firing another rifle cartridge.

To date, most automatic and semi-automatic firearms, like the AR-15, have been configured to fire rifle cartridges only. There are, however, modifications available which convert an AR-15 firearm meeting military specifications (mil-spec) into an assault-style firearm capable of firing 9 mm ammunition, such as the 9×19 mm Parabellum cartridge. These modified firearms generally include an upper receiver modified to chamber and fire the smaller 9 mm ammunition compared to the larger rifle ammunition. The barrel, bolt carrier group and buffer spring are also modified to accommodate the smaller cartridges. To provide the 9 mm cartridges to the firearm, a number of attempts have been made to modify the AR-15 to mount a 9 mm caliber magazine with the AR-15 lower receiver. For instance, modified AR-15 lower receivers have been manufactured to receive a 9 mm magazine. However, these lower receivers do not meet military specifications. Alternatively, conversion blocks have been developed whereby the mil-spec magazine well of the AR-15 is configured to mount an adapter which in turn receives the 9 mm magazines. While these systems utilize the mil-spec AR-15 magazine well, they require fastening of the conversion block to the lower receiver thereby increasing complexity and build times.

As such, there is a need for a 9 mm magazine adapter which is configured to mount within a magazine well of a lower receiver meeting military specifications, such as that of an M-16 or AR-15, without requiring the disassembly of the firearm or the use of additional tools. The present invention addresses these and other needs.

BRIEF SUMMARY OF THE INVENTION

In general, an exemplary embodiment of the present invention is directed to a magazine adapter for use in a firearm. The magazine adapter comprises a magazine adapter body configured to be bottom-fed and detachably received within a magazine well on the firearm. The magazine adapter includes a magazine adapter body having a bottom panel defining a hole therethrough, and an upwardly extending first panel and an upwardly extending second panel defining a channel therebetween. The hole and channel are proportioned to slidably receive a magazine therein. The second panel defines a recess configured to engage a firearm magazine catch on the firearm when the magazine adapter body is received within the magazine well and the magazine adapter body is configured to detach from the magazine well when the firearm magazine catch is actuated. The first panel includes an adapter magazine catch configured to releasably engage the magazine when the magazine is received within the magazine adapter channel. A magazine release is coupled to the adapter magazine catch and is configured to cause the adapter magazine catch to disengage from the magazine when the magazine release is actuated.

In a further aspect of the present invention, the magazine release comprises a pin having first and second ends. The first end is coupled to the adapter magazine catch and the second end extends outwardly from the bottom panel. Actuation of the pin at the second end drives the first end to translate the adapter magazine catch so as to disengage the adapter magazine catch from the magazine. The pin may include a notch an intermediate distance between the first and second ends. The first panel includes a post positioned within a portion of the notch, whereby actuation of the pin is constrained by the post in the notch.

In still a further aspect of the present invention, the magazine adapter further includes a last round bolt hold open configured to engage a bolt on the firearm after a last round of ammunition has been fired by the firearm. Also, the second panel may further include an upwardly extending ejector configured to engage a casing of a fired cartridge during reloading of the firearm. The first panel may include a ramp surface configured to assist feeding of a cartridge from the magazine into a chamber of the firearm. Each of the first panel and second panel may also include a respective inner wall surface defining the channel. The inner wall surfaces may be in spaced parallel relation to one another and may be disposed at an angle relative to the plane defined by the bottom panel of the magazine adapter body.

In yet a further aspect of the present invention, the magazine adapter body is configured to mount within a military specification (mil-spec) AR-15 magazine well and the channel is configured to receive a magazine configured to hold 9 mm ammunition cartridges. The magazine adapter body may be configured to receive a GLOCK 9 mm magazine.

In a further embodiment of the present invention, a magazine adapter for use in an M16/AR-15 military specification (mil-spec) firearm comprises a magazine adapter body configured to be bottom-fed and detachably received within a mil-spec magazine well on the M16/AR-15 mil-spec firearm. The magazine adapter includes the magazine adapter body having a bottom panel, and an upwardly extending first panel and an upwardly extending second panel defining a channel proportioned to slidably receive a magazine therein. The second panel defines a recess configured to engage a firearm magazine catch on the M16/AR-15 mil-spec firearm when the magazine adapter body is received within the mil-spec magazine well. The magazine adapter body is also configured to detach from the mil-spec magazine well when the firearm magazine catch is actuated. The first panel includes an adapter magazine catch configured to releasably engage the magazine when the magazine is received within the magazine adapter channel. A magazine release coupled to the adapter magazine catch is configured to cause the adapter magazine catch to disengage from the magazine when the magazine release is actuated. Also included is a pin having first and second ends, with the first end coupled to the adapter magazine catch and the second end extending outwardly from the bottom panel of the magazine adapter body. Actuation of the pin at the second end drives the first end to translate the adapter magazine catch so as to disengage the adapter magazine catch from the magazine.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
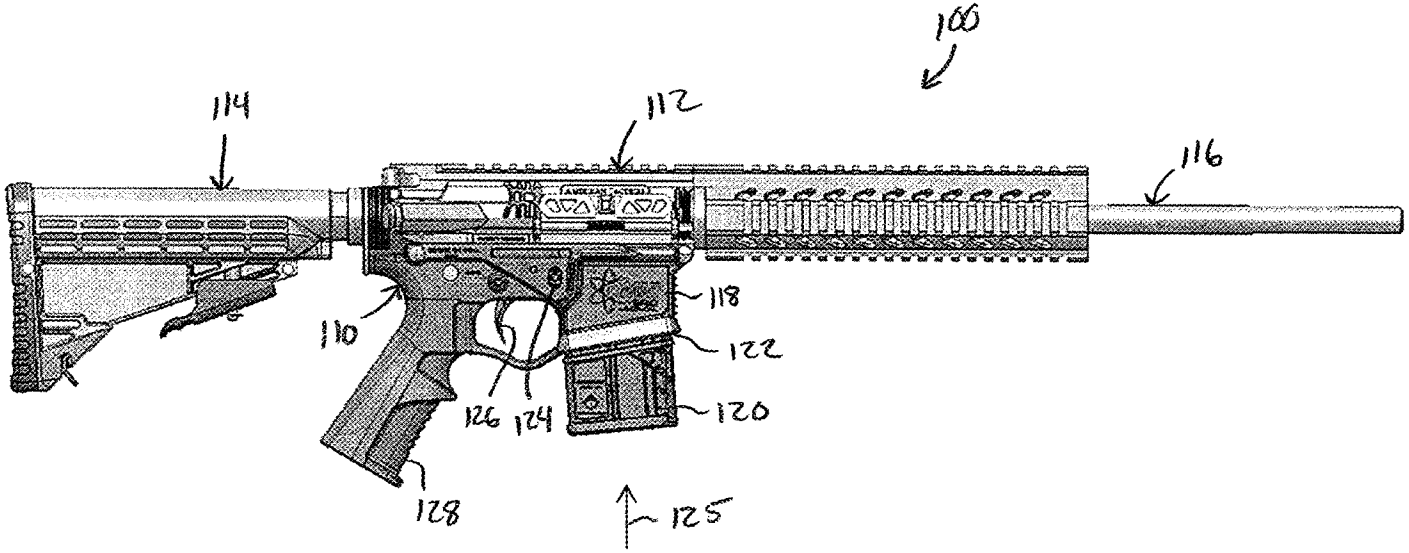
FIG. 1 is a side view of a representative firearm amenable for use with an embodiment of a magazine adapter in accordance with the present invention.

Referring to the drawings in detail, and specifically to FIG. 1, a firearm, such as the AR-15, is generally indicated by reference numeral 100. Firearm 100 may be a modular firearm consisting of a number of components and subcomponents. Major components of firearm 100 may include lower receiver assembly 110, upper receiver assembly 112, buttstock assembly 114 and barrel assembly 116. To assemble a completed firearm, upper receiver assembly 112 is coupled to lower receiver assembly 110 while buttstock assembly 114 is connected to the lower receiver assembly 110 and barrel assembly 116 is mounted onto upper receiver assembly 112. Lower receiver assembly 110 is configured to include a magazine well 118 adapted to slidably receive a magazine 120 therein. Activation of the firing mechanism (not shown) is controlled by trigger 126. A grip 128 (such as a pistol grip, as shown) allows the user to aim and control the firearm while placing the user's trigger index finger in close proximity to the trigger. In this manner, the user can aim the firearm to the target and extend the trigger index finger to engage the trigger without losing control or accuracy of the firearm.

Most assault-type firearms are configured to be operated as rifles and include a rifled barrel and are chambered to receiver and fire rifle cartridges. By way of example, the most ubiquitous civilian assault weapon, the AR-15, is generally chambered for standardized rounds such as the Remington .223 cartridge or the 5.56×45 mm NATO military cartridge. As a result, magazines, and more importantly the magazine well of the AR-15 configured to receive these magazines, have been standardized, with such standardization being generally referred to as meeting United States Military Standards or, more commonly as being "mil-spec". Specifically, as used herein, the terms "mil-spec" and "mil-spec M16/AR-15" shall refer to the structural specificities defined by the United States Department of Defense as of Jan. 22, 2018, the date of filing of U.S. patent application Ser. No. 62/620,440, the patent application of which the present application claims benefit.

Assault weapons, such as the AR-15, have also been modified to chamber and fire .410 bore shotgun shells, but these modifications require lower receivers which no longer satisfy military specifications (mil-spec). Other modifications continue to result in jamming or binding of the shotgun shell cartridges when a cartridge has been fired, its shell is being ejected, or a new cartridge is being extracted from the magazine and loaded within the chamber. To that end, Applicant has produced a shotgun shell magazine configured to feed shells from the magazine into a mil-spec AR-15/M16 lower receiver (see commonly owned U.S. Pat. No. 9,664,469 (the '469 Patent) issued May 30, 2017, the entirety of which is incorporated by reference herein).

Assault weapons, such as the AR-15 have further been modified to chamber and fire pistol rounds, such as the 9×19 mm Parabellum cartridge. However, these modified weapons frequently require lower receivers which do not meet military specifications. Conversion blocks have been developed whereby the mil-spec magazine well of the AR-15 is configured to mount an adapter which in turn receives the 9 mm magazines, but while these systems utilize the mil-spec AR-15 magazine well, they require fastening of the conversion block to the lower receiver thereby increasing complexity and build times.

Figure 2:
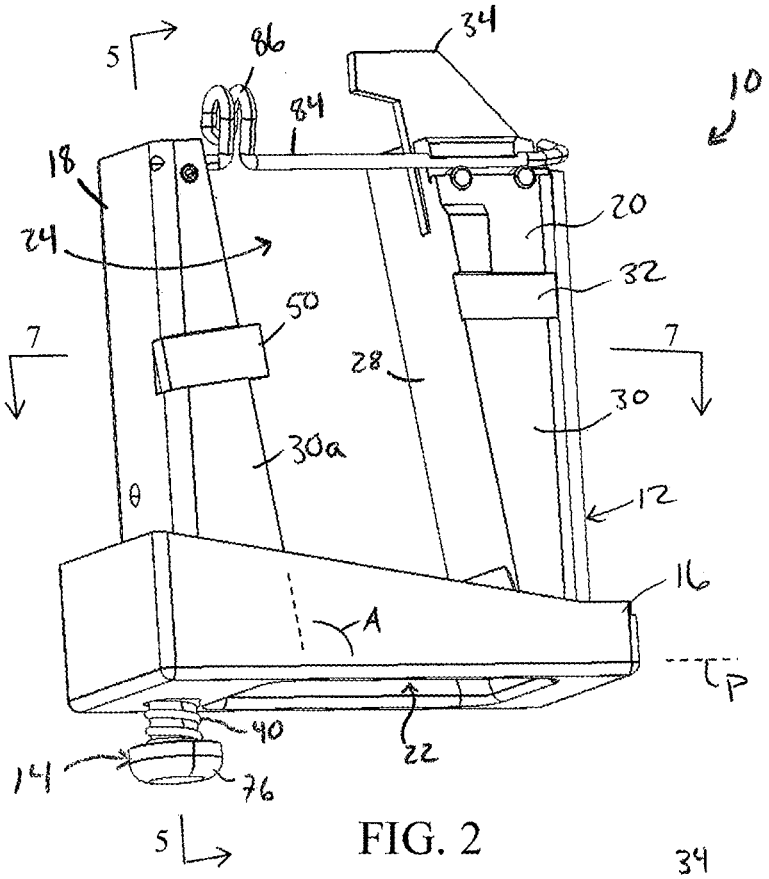
FIG. 2 is a front, bottom perspective view of an embodiment of a magazine adapter in accordance with the present invention.
Figure 3:
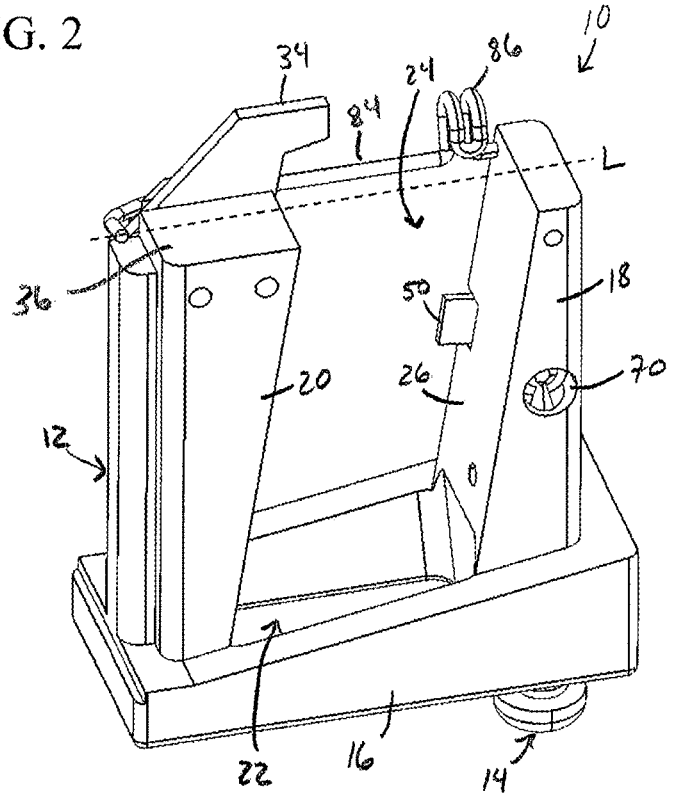
FIG. 3 is a back, top perspective view of the magazine adapter shown in FIG. 2.

Thus, turning now to FIGS. 2 and 3, an embodiment of a magazine adapter 10 in accordance with the present invention generally includes a magazine adapter body 12 and magazine release assembly 14 mounted therein. Magazine adapter body 12 is configured to be bottom-fed within a magazine well, such as magazine well 118 of firearm 110, whereby magazine adapter body 12 is slidingly inserted upwardly through well edge 122 as generally indicated by arrow 125 as shown in FIG. 1. To that end, magazine adapter body 12 includes a bottom panel 16 and upwardly extending first and second panels 18, 20 proportioned to be slidingly received within magazine well 118. Bottom panel 16 defines a hole 22 therethrough while first and second panels 16, 18 define a channel 24 therebetween wherein channel 24 is in communication with hole 22. Hole 22 and channel 24 are proportioned to receive a magazine (not shown) therein. In accordance with an aspect of the present invention, the magazine may hold 9 mm ammunition cartridges; and in a further aspect magazine adapter body 12 may be configured to receive a GLOCK 9 mm magazine therein. Specifically, as used herein, the terms "GLOCK 9 mm" and "GLOCK 9 mm magazine" shall refer to the structural specificities of the handguns sold by Glock, Inc. configured to fire 9×19 mm Parabellum cartridges as of Jan. 22, 2018, the date of filing of U.S. patent application Ser. No. 62/620,440. Respective inner wall surfaces 26, 28 of first and second panels 18, 20 are generally arranged in spaced parallel relation to one another, and in a further aspect of the invention may be disposed at an angle A relative to plane P defined by bottom panel 16. Angle A may be selected so as to replicate the angle of the grip of the handgun which typically receives the magazine (e.g., the grip angle of a GLOCK 9 mm firearm). In this manner, the 9 mm cartridges within the magazine may be properly fed into the chamber of firearm 100 via reciprocal travel of the bolt carrier group therein, as is known in the art.

Figure 6:
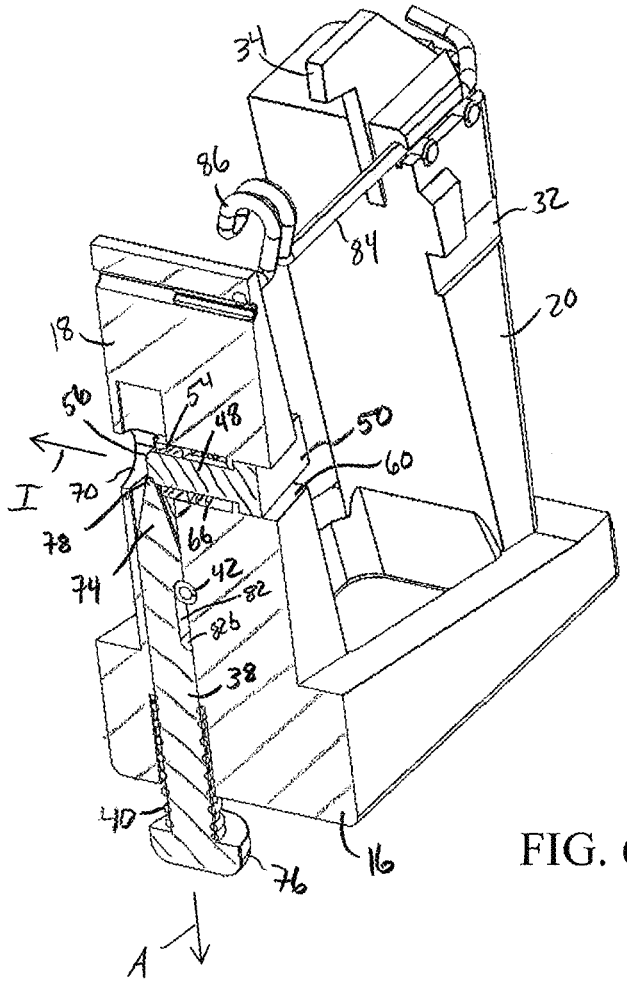
FIG. 6 is a perspective cross section view of the magazine adapter shown in FIG. 2 showing the magazine release in a non-actuated orientation.
Figure 8:
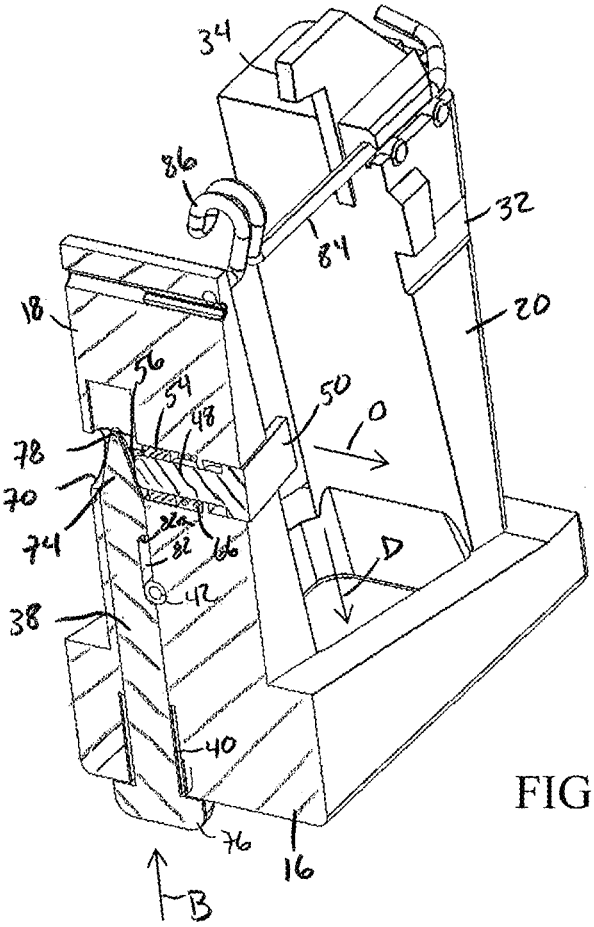
FIG. 8 is a perspective cross section view of the magazine adapter shown in FIG. 2 showing the magazine release in an actuated orientation.

As shown in FIG. 2, with additional reference to FIGS. 6 and 8, front side wall 30 of second panel 20 includes a recess 32 defined therein. In one aspect of the present invention, recess 32 is proportioned and positioned on second panel 20 so as to coincide with a firearm magazine catch located on the lower receiver of the firearm (i.e., lower receiver assembly 110 of firearm 100). Once magazine adapter body 12 has been fully inserted within the magazine well (i.e., magazine well 118, as described above), the firearm magazine catch on the lower receiver will reside within recess 32 thereby preventing unwanted removal of magazine adapter 10 from the firearm. The lower receiver may also include a magazine release, such as magazine release 124 shown in FIG. 1, whereby actuation of the magazine release will withdraw the magazine catch from recess 32 such that magazine adapter 10 may be removed from magazine well 118 of lower receiver assembly 110.

Figure 5:
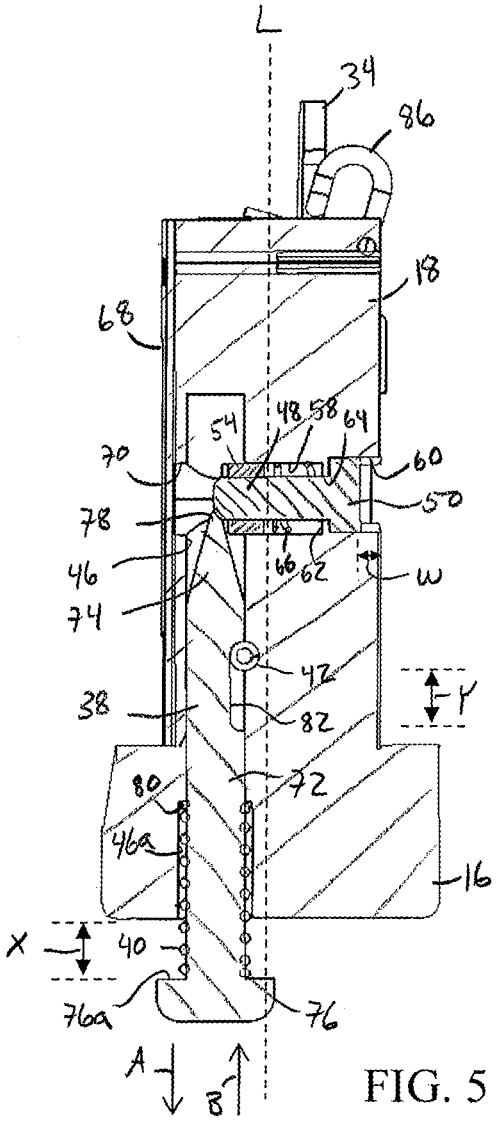
FIG. 5 is a cross section view of the magazine adapter shown in FIG. 2, taken generally along line 5-5 thereof.

Referring now to FIGS. 3 and 5, second panel 20 may further include an ejector 34 extending upwardly of top face 36 of second panel 20. In accordance with an aspect of the invention, ejector 34 is offset from the longitudinal axis L of magazine adapter body 12 toward front side wall 30. Ejector 34 is configured to impact the rimmed edge of the casing of a fired 9 mm cartridge during cycling of the bolt carrier group whereby the fired casing may be ejected from the firearm.

Figure 4:
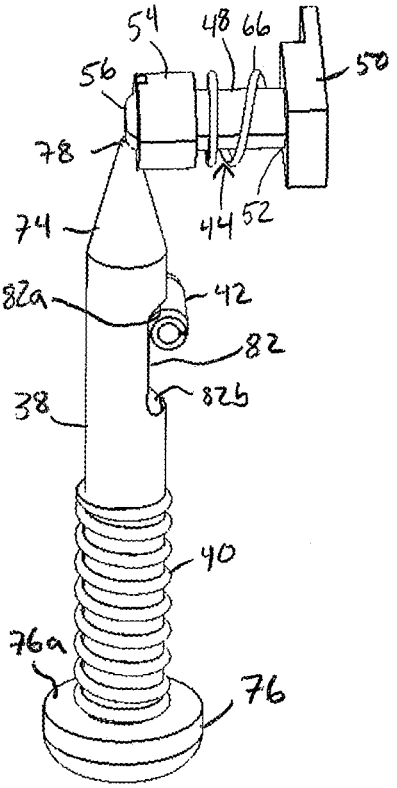
FIG. 4 is an isolated view of a magazine release configured for use within the magazine adapter shown in FIG. 2.

With reference to FIGS. 2-5, first panel 18 is configured to receive magazine release assembly 14 therein. As shown in FIGS. 4 and 5, magazine release assembly 14 generally includes a pin 38, biasing member 40, post 42 and adapter magazine catch 44. Pin 38 is adapted to travel within slot 46 defined within first panel 18. Pin 38 is coupled to adapter magazine catch 44 such that actuation of pin 38 causes a resultant translation of adapter magazine catch 44, as will be discussed in greater detail below. To that end, adapter magazine catch 44 may generally comprise an L-shaped member having a shaft 48 coupled to an arm 50 at a first end 52. A nut 54 is threadably coupled to second end 56 of shaft 48. Shaft 48 is configured to reside within bore 58 defined within first panel 18 while arm 50 seats within groove 60 defined within front side wall 30*a* of first panel 18. Wall portion 62 separates bore 58 from groove 60 and includes a hole 64 defined therein through which passes shaft 48. Biasing member 66 is located on shaft 48 between nut 54 and wall portion 62 so as to bias arm 50 against wall portion 62 when magazine release assembly 14 is in an unbiased orientation such that the outer face of arm 50 of adapter magazine catch 44 is a spaced distance W from the face of front side wall 30*a*, as will be discussed in greater detail below. To permit threading of nut 54 onto second end 56 of shaft 48, rear side wall 68 of first panel 18 may define a hole 70 configured to coincide with bore 58 whereby nut 54 may be passed through rear side wall 68 so as to threadably engage shaft 48.

Returning now to pin 38, and with reference to FIGS. 4 and 5, pin 38 includes a shank portion 72 having opposing first and second ends 74, 76. First end 74 is configured to have a generally conical shape with the cone apex 78 engaging second end 56 of shaft 48 when magazine release assembly 14 is in the unbiased orientation. Shank portion 72 has a length such that second end 76 extends outwardly of bottom panel 16 and is a spaced distance X from the outer face of bottom panel 16. A portion of slot 46 located within bottom panel 16 has a larger diameter than the remainder of slot 46 so as to define an enlarged slot 46*a*. Enlarged slot 46*a* defines a slot step 80 at one end and terminates at the outer face of bottom panel 16 at the other end. Enlarged slot 46*a* is configured to receive biasing member 40 therein wherein one end 40*a* of biasing member 40 seats against slot step 80. Second end 76 has a diameter larger than the diameter that the remainder of shank portion 72 whereby the inner face 76*a* of second end 76 seats the opposing end 40*b* of biasing member 40 thereon. In this manner, biasing member 40 urges pin 38 out of slot 46 in the direction shown generally by arrow A.

To constrain movement of pin 38 within slot 46, shank potion 72 may define a notch 82 located an intermediate distance between first and second ends 74, 76. Post 42 is inserted within and fixedly secured to first panel 18 whereby post 42 resides within a portion of notch 82 and a length Y of notch 82 remains unobstructed. In this manner, as shown in FIG. 5, when magazine release assembly 14 is in the unbiased orientation, biasing member 40 urges pin 38 in direction A a distance X until post 42 engages top wall 82*a* of notch 82. In accordance with an aspect of the invention, unobstructed length Y of notch 82 is proportioned to be the same as or slightly longer than distance X. Thus, upon actuation of magazine release assembly 14, post 42 may be directed into slot 46, such as in direction B, until inner face 76*a* of second end 76 contacts or nearly contacts the outer face of bottom panel 16 and post 42 contacts bottom wall 82*b* of notch 82, as will be discussed in greater detail below.

Referring again to FIGS. 2 and 3, magazine adapter 10 may further include a last round bolt hold open (LRBHO) 84. LRBHO 84 may generally comprise a wire member extending between first and second panels 18, 20. LRBHO 84 may include a rolled portion 86 spaced an intermediate distance between first and second panels 18, 20 with rolled portion 86 located within or overlapping a portion of channel 24. Rolled portion 86 may be positioned so as to engage the bolt of the firearm after the last 9 mm cartridge has been fired. That is, so long as live ammunition is present within the 9 mm magazine, the bolt carrier group will cycle ejection and chambering of the ammunition as is known in the art with automatic and semi-automatic firearms. However, after firing of the last 9 mm cartridge, the bolt carrier group will engage rolled portion 86 of LRHBO 84 such that the bolt is prevented from advancing toward the chamber but is instead held in the open position against rolled portion 86.

Figure 7:
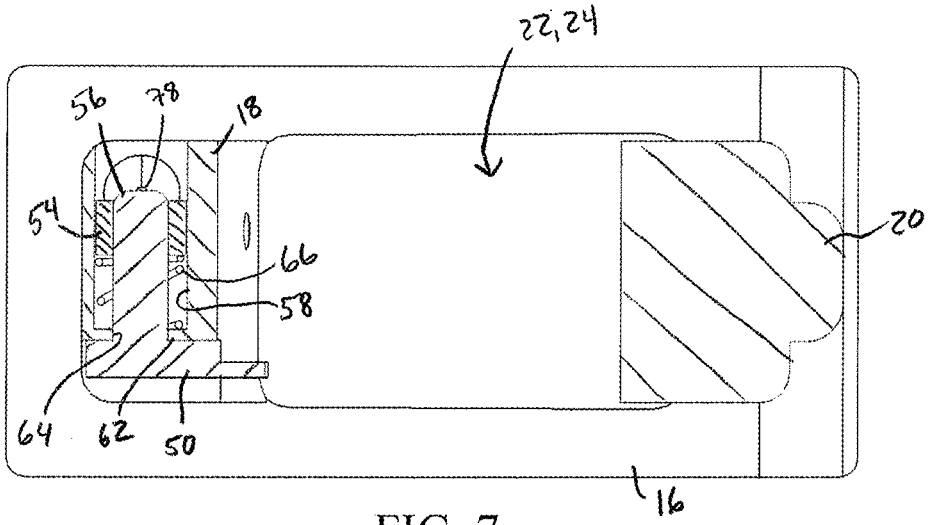
FIG. 7 is a cross section view of the magazine adapter shown in FIG. 2, taken generally along line 7-7 thereof and showing the magazine release in a non-actuated orientation.

In accordance with the above discussion, operation of magazine adapter 10, and particularly magazine release assembly 14, will be discussed in view of FIGS. 6-9. FIGS. 6 and 7 illustrate magazine release assembly 14 in a non-actuated orientation while FIGS. 8 and 9 have magazine release assembly 14 in the fully actuated orientation. As shown in FIGS. 6 and 7, pin 38 is in the non-actuated orientation such that biasing member 40 urges pin 38 in direction A until top wall 82*a* of notch 82 engages post 42 secured within first panel 18. As a result, cone apex 78 of pin 38 is situated within slot 46 such that biasing member 66 urges second end 56 of shaft 48 inwardly as shown generally by arrow I. Adapter magazine catch 44 is thereby directed inwardly in direction I within groove 60 such that a portion of arm 50 resides within channel 24. Thus, when magazine release assembly 14 is in the non-actuated orientation, adapter magazine catch 44 is configured to engage a recess on the 9 mm magazine so as to releasably secure the 9 mm magazine with magazine adapter 10.

Figure 9:
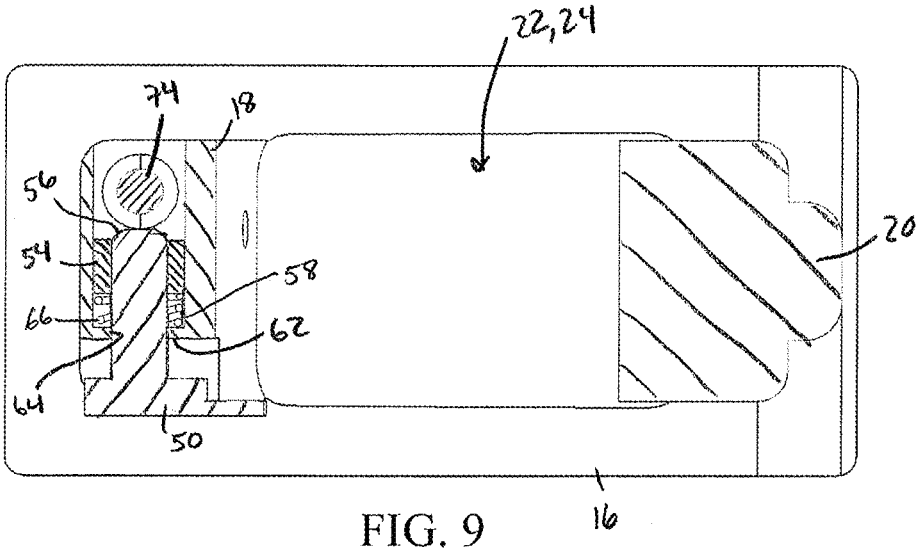
FIG. 9 is a cross section view of the magazine adapter shown in FIG. 2, showing the magazine release in an actuated orientation.

Turning now to FIGS. 8 and 9, magazine release assembly 14 has been fully actuated by applying an actuating force to pin 38 so as to direct pin 38 inwardly into adapter body 12 in the direction of arrow B, such as through manually pushing second end 76 of pin 38. Inward travel of pin 38 causes second end 76 of pin 38 compress biasing member 40 within enlarged slot 46*a* and thereby cause potential energy to be stored within biasing member 40. Inward travel of pin 38 also causes the sloped surface of first end 74 of pin 38 to ride against second 56 of shaft 48 thereby driving shaft 48 and arm 50 generally in direction O. Arm 50 moves in direction O until adapter magazine catch 44 has disengaged from the recess on the 9 mm magazine residing with channel 24. In this manner, the 9 mm magazine may be selectively withdrawn from magazine adapter 10 generally in direction D. As shaft 48 and arm 50 travel in direction O, nut 54 compresses biasing member 66 against wall 62, thereby storing potential energy within biasing member 66. Upon release of the actuating force upon second send 76 of pin 38, the potential energy stored within biasing member 40 may be used to urge second end 76 downwardly in direction A (FIG. 6). As the sloped surface of first end 74 of pin 38 travels in direction A, the stored potential energy within biasing member 66 may then urge nut 54 in direction I (FIG. 6) such that shaft 48 and arm 50 translate in groove 60 whereby adapter magazine catch 44 may again reside with a recess on a 9 mm magazine.

As can be seen by the above discussion, magazine adapter 10 enables a user to remove magazine adapter 10 through actuation of the magazine release mechanism on the firearm (i.e., firearm magazine release 124 of firearm 100). In this manner, magazine adapter 10 and any 9 mm magazine resident within channel 24 may be selectively removed from firearm 100. Alternatively, magazine adapter 10 also allows a user to remove the 9 mm magazine from magazine adapter 10 while magazine adapter 10 remains secured with the magazine well of the firearm (i.e., magazine well 118 of firearm 100). In accordance with one aspect of the present invention, magazine adapter 10 is configured to reside with the magazine well of a mil-spec AR-15 lower receiver assembly without requiring any modification of the lower receiver assembly or magazine well.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A magazine adapter for use in a firearm, the magazine adapter comprising a magazine adapter body configured to be bottom-fed and detachably received within a magazine well on the firearm, wherein the magazine adapter includes:

a) the magazine adapter body having a bottom panel defining a hole therethrough, an upwardly extending first panel and an upwardly extending second panel defining a channel therebetween and in communication with the bottom panel hole, wherein the hole and channel are proportioned to slidably receive a magazine therein, wherein the second panel defines a recess configured to engage a firearm magazine catch on the firearm when the magazine adapter body is received within the magazine well and wherein the magazine adapter body is configured to detach from the magazine well when the firearm magazine catch is actuated, and wherein the first panel includes an adapter magazine catch configured to releasably engage the magazine when the magazine is received within the magazine adapter channel; and b) a magazine release coupled to the adapter magazine catch, wherein the adapter magazine catch is configured to disengage from the magazine when the magazine release is actuated, wherein the magazine release comprises a pin adapted to be received within a slot defined within the first panel, wherein a first end of the pin is coupled to the adapter magazine catch and a second end of the pin extends outwardly from the bottom panel, and wherein the pin includes a notch located an intermediate distance between the first and second ends, and wherein the first panel includes a post fixedly secured within the first panel and positioned within a portion of the notch, whereby the magnitude of actuation of the pin is constrained by the post in the notch, wherein actuation of the pin at the second end drives the first end from a first position to a second position to translate the adapter magazine catch and disengage the adapter magazine catch from the magazine.

2. The magazine adapter in accordance with claim 1 wherein the magazine adapter further includes a last round bolt hold open configured to engage a bolt of the firearm after a last round of ammunition has been fired by the firearm.

3. The magazine adapter in accordance with claim 1 wherein the second panel further includes an upwardly extending ejector configured to engage a casing of a fired cartridge during reloading of the firearm.

4. The magazine adapter in accordance with claim 1 wherein each of the first panel and second panel includes a respective inner wall surface in spaced parallel relation to one another thereby defining the channel.

5. The magazine adapter in accordance with claim 4 wherein the inner wall surfaces are in spaced parallel relation to one another and disposed at an angle relative to the plane defined by the bottom panel of the magazine adapter body.

6. The magazine adapter in accordance with claim 1 wherein the first panel includes a ramp surface configured to assist feeding of a cartridge from the magazine into a chamber of the firearm.

7. The magazine adapter in accordance with claim 1 wherein the channel is configured to receive a magazine configured to hold 9 mm ammunition cartridges.

* * * * *